United States Patent [19]

Hastings

[11] 4,241,880

[45] Dec. 30, 1980

[54] ELECTROSTATIC SPRAY GUN

[75] Inventor: Donald R. Hastings, Elyria, Ohio

[73] Assignee: Nordson Corporation, Amherst, Ohio

[21] Appl. No.: 21,197

[22] Filed: Mar. 16, 1979

[51] Int. Cl.[3] ..... B05B 5/02

[52] U.S. Cl. ..... 239/691

[58] Field of Search ..... 239/690–708, 239/3; 361/225, 227, 228

[56] References Cited

U.S. PATENT DOCUMENTS

| | | | |
|---|---|---|---|
| 3,459,374 | 8/1969 | Probst | 239/707 |
| 3,583,632 | 6/1971 | Shaffer et al. | 239/705 |
| 3,938,740 | 2/1976 | Bertilsson et al. | 239/707 |

*Primary Examiner*—Andres Kashnikow

*Attorney, Agent, or Firm*—Wood, Herron & Evans

[57] ABSTRACT

An improved electrostatic spray gun is disclosed including an electrically conductive metal handle assembly, an electrically insulative barrel assembly, and an electrically insulative nozzle assembly terminating at its forward end in a small diameter discharge orifice through which the coating material is ejected. An ionizing electrode protrudes from the discharge orifice. The flow of material through the barrel and the nozzle assembly is controlled by a trigger actuated needle and seat valve assembly close to the discharge orifice and in axial alignment with an annular fluid flow passageway in the barrel portion of the gun. A high value resistor is disposed in the barrel portion of the gun and a second lower value resistor is disposed inside the needle valve immediately upstream of the ionizing electrode. The elements of the improved electrostatic spray gun cooperate to provide clean and safe operation.

11 Claims, 2 Drawing Figures

ELECTROSTATIC SPRAY GUN

BACKGROUND OF THE INVENTION

This invention relates to electrostatic spray systems. More specifically, this invention relates to an improvement over the electrostatic coating apparatus disclosed in U.S. Ser. No. 877,445 filed Feb. 13, 1978, in the name of J. Kennon, now U.S. Pat. No. 4,182,490, and my co-pending application, U.S. Ser. No. 971,514, filed Dec. 20, 1978, both assigned to the assignee of this invention.

In conventional electrostatic spray coating systems, a fluid coating material such as paint, varnish, lacquer and the like is projected toward an object to be coated in an atomized or particulate form from a dispensing device. The object to be coated is held at electrically ground potential and either just before, at, or just after being dispensed from the gun, the coating material is imparted an electrical charge so that it will be electrostatically attracted toward the object to be coated.

In such systems, it is important that a uniform, smooth, thin coating be deposited on the surface of the object and that a high percentage of the coating material be deposited. The latter criterion is referred to as the transfer efficiency of the system. The transfer efficiency is related to the efficiency of charging the coating material, and workers in the art are moving toward operating at higher charging voltages, e.g., voltages up to 120 kv. However, the use of such high voltages presents certain problems. That is, when spraying many of the coating materials in use today, including powders, a flammable atmosphere results in the area of the coating operation. The high voltage electrostatic charging circuit through the gun causes energy to be capacitively stored in the metallic components of the gun. Thus, if the gun is brought too close to any grounded object, the possibility arises that a spark will jump between the high voltage circuit in the gun and the grounded object igniting the flammable atmosphere in the coating area. The amount of this capacitively stored energy increases as the square of the voltage.

The aforementioned patent application, U.S. Ser. No. 877,445, shows an electrostatic spray gun having safer operation including a high-valued resistor in the barrel of the gun and a lower-valued resistor in the nozzle of the gun closely adjacent to a material charging electrode projecting from the nozzle effective in damping out the stored energy except for a small amount due to the electrode itself. The material flow and control system shown there, which is much like that shown in my patent, U.S. Pat. No. 3,747,850, has multiple passageways in the barrel of the gun feeding the nozzle out of which the material is eventually ejected as well as a material flow control valve located well inside the barrel of the gun.

SUMMARY OF THE INVENTION

It has been among the principle objects of this invention to provide an improved electrostatic spray gun capable of safely operating at relatively high voltages with reduced capacitively stored electrical energy.

It has been a further objective of this invention to provide such an improved electrostatic spray gun having an improved material flow control system for clean operation. That is, it has been an objective of this invention to provide such an improved electrostatic spray gun having the material flow control valve close to the material discharge orifice to minimize the amount of paint left in the gun downstream of the nozzle between spraying operations as well as to provide ease of access to the material flow control valve for inspection, maintenance and repair or replacement.

It has been a still further objective of this invention to provide such an improved electrostatic spray gun which is compact, simple in construction and easy to manufacture.

These and other objects of this invention are achieved by providing an improved electrostatic spray gun having a new and unique combination of components wherein the material flow control valve and the forward portion of the high voltage charging circuit are combined in the nozzle portion of the gun very close to the discharge orifice of the nozzle. More specifically, in the improved electrostatic spray gun of this invention the valve means, forwardmost resistor in the high voltage charging circuit, and the ionizing electrode are present in one element very close to the discharge orifice of the gun nozzle and substantially "in-line" with a single axial material flow passageway through the barrel of the gun.

In accordance with a presently preferred form of the invention, the gun includes a barrel portion with a high voltage electrical path in it with a resistor comprising part of the electrical path in the barrel and a nozzle assembly attached to the barrel portion. The nozzle assembly is made of a substantially non-conductive material having an annular fluid passage ending in a discharge orifice at the forward end of the nozzle and having a cone-shaped valve seat formed inside the nozzle close to the discharge orifice. The nozzle fluid passage is substantially axially aligned with and communicates directly with the material flow passageway in the barrel of the gun. Flow of material through the discharge orifice is controlled by a trigger-actuated control rod which is axially slidable in the passages in the barrel and nozzle and which terminates at its forward end in a coned-tip seated in the nozzle valve seat. The material flow control valve is thus very close to the forwardmost portion of the gun.

The forward end of the control rod further includes a second resistor inside the rod and a thin wire-like electrode extending therefrom. The electrode extends through the discharge orifice and thus lies in the stream of material being discharged from the nozzle. The second resistor is connected to the high voltage electrical path passing through the barrel of the gun by means of a metal spring which forms the electrical connection while permitting axial movement of the control rod in a forward and rearward direction in the material flow passages.

The path of the high voltage charging circuit through the gun is thus through the first series resistor in the barrel of the gun, through a small electrode connecting the first resistor to the spring, and through the spring to the second series resistor in the forward end of the control rod to the charging electrode projecting out of the discharge orifice. The resistor in the barrel and the resistor in the forward end of the control rod combine to effectively damp out the stored energy in the gun rearwardly or "upstream" of the charging electrode. Thus, all the stored energy in the gun is damped out except for a small amount due to the electrode itself. Accordingly, it has been found that the electrostatic spray gun of the present invention may be safely operated at relatively high voltages, e.g., 120 kv (open circuit).

Moreover, the gun operates cleanly and is easy to keep clean and to maintain in an operable condition. Further, the number of internal passageways is reduced thereby providing manufacturing advantages.

Other objects and advantages of the present invention will be apparent from the following detailed description of the invention taken with the accompanying drawings.

DETAILED DESCRIPTION OF THE INVENTION

Figure 1:
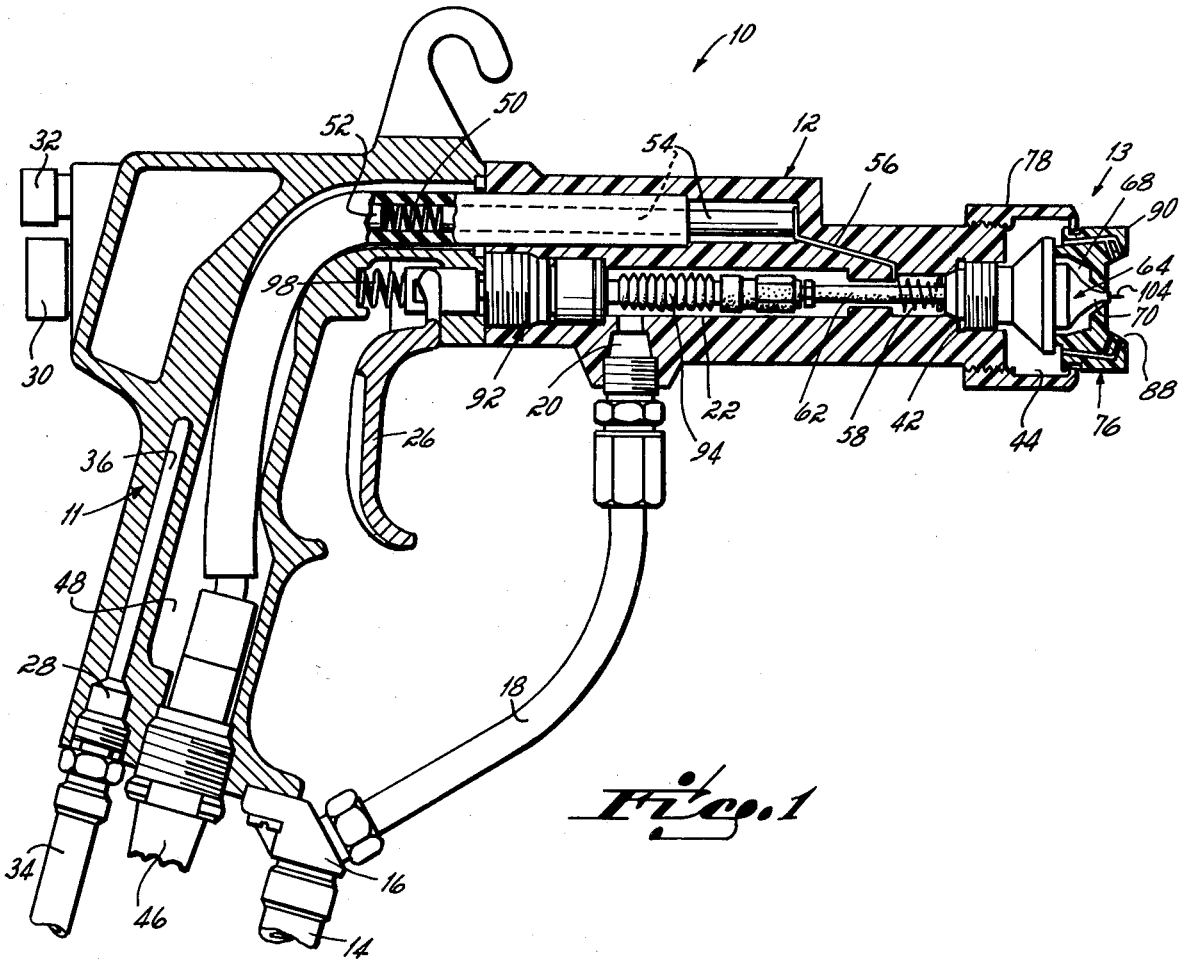
FIG 1 is a partial cross-sectional view of the electrostatic spray gun of this invention.

The gun 10 illustrated in FIG. 1 of the drawings is an air operated electrostatic spray gun which relies upon the impact of an air stream with a liquid stream to effect atomization of the liquid stream.

The gun 10 comprises an electrically grounded metal handle assembly 11, an electrically insulative barrel assembly 12 and an electrically insulative nozzle assembly 13 at the forward end of the barrel 12. Paint or other spray coating material which may be in the nature of a coating, varnish or lacquer (referred to in regard to this invention generically as paint) is supplied to the gun under pressure from an external reservoir or tank (not shown) through a hydraulic hose 14.

Figure 2:
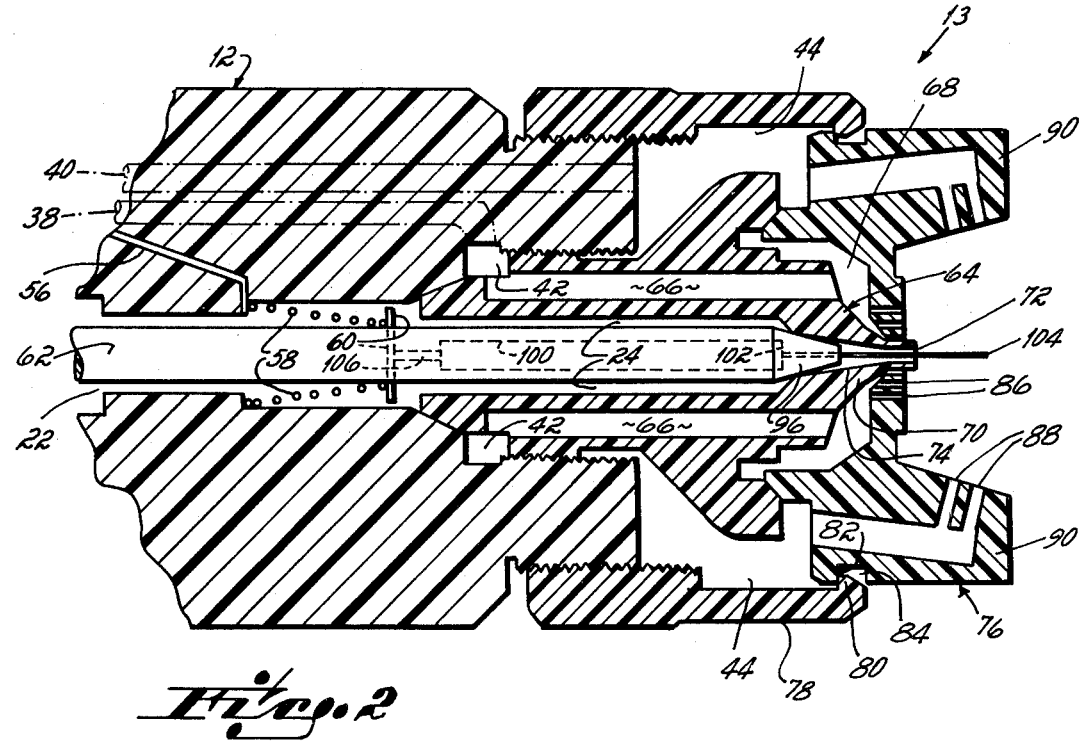
FIG. 2 is an axial cross-sectional view of the nozzle portion of the electrostatic spray gun shown in FIG. 1.

The hose 14 is connected to an electrically conductive lug 16 attached to the butt end of the handle 11 and having a fluid passage through it so as to connect a fluid passage in the hose 14 to a fluid passage in a hose 18 connected between the lug 16 and an inlet passage 20 in the side of the barrel 12. The inlet passage 20 through the side of the barrel 12 communicates with an annular, axial fluid flow passageway 22 in the barrel 12. The passageway 22 in turn communicates at its forward end with a central annular axial passage 24 in the nozzle assembly 13 (FIG. 2). The passages 22 and 24 are substantially axially aligned. A trigger 26 operates a needle and seat valve assembly in the passage 24 for controlling the flow of fluid out of the nozzle 13 as hereinafter described in detail.

The handle assembly 11 is made from a metal casting and includes an air inlet 28, a trigger actuated internal air flow control valve 30, the trigger 26 controlling the flow of air through the valve 30. There is also an adjustable air valve 32 in the gun handle for controlling the shape or "fan" of the spray emitted from the gun.

An air hose 34 is connected to the butt end of the handle 11 by suitable couplings and communicates through the air inlet 28 with a generally vertical air passage 36 in the handle 11. The air passage 36 continues in a plane other than that shown in the figure through the air flow control valves 30 and 32 and eventually communicates with a pair of internal passages 38, 40 passing through the barrel 12 of the gun and terminating at the forward end of the barrel in communication with air chambers 42 and 44, respectively, in the nozzle 13 (FIG. 2). Passage 38 provides the atomizing air while passage 40 provides the fan-shaping air. The flow of air through the passages 38, 40 is controlled by the trigger operated air control valve 30 while the flow of fan air through the passage 40 is further controlled by the fan control valve 32.

A high voltage source of electrical energy is supplied to the gun by a cable 46 from an external electrical power pack (not shown). The high voltage cable 46 connects into the butt of the handle 11 and continues through the handle 11 through a passage 48 which extends into the barrel 12. An electrically conductive spring 50 is compressed between the end 52 of the high voltage cable 46 and a resistor 54. The spring 50 serves to provide electrical connection between the end of the cable and the resistor. The resistor is generally on the order of 75 megohms, but it can be more or less depending on the voltage being supplied through the cable 46 to the gun. The forward end of the resistor is connected by means of a small electrical conductor 56 to a conical spring 58 in contact with the pin 60 mounted in an electrically nonconductive control rod 62 in the material flow passageways 22 and 24.

Referring now to FIG. 2, the nozzle assembly 13 will be described. A preferred form of the nozzle assembly is shown in my co-pending application Ser. No. 971,514, assigned to the assignee of this invention, and that disclosure is incorporated herein by reference. In general, the nozzle assembly is made of an electrically nonconductive material such as an acetal homopolymer commonly known by the du Pont trademark "Delrin." Delrin 500 and 550 are presently preferred materials of construction. The nozzle 13 has a fluid tip 64 which is threaded at its rear into a counterbore in the forward end of the barrel 12. The fluid tip 64 has a number of circumferentially spaced axial passages 66 which open at their rear into the counterbore to communicate with the air passage 42 such that atomizing air passing through the passage 38 into the passage 42 may enter and pass through the axial passages 66 in the fluid tip and into an internal chamber 68 surrounding the forward end of the fluid tip. The fluid tip also includes the central axial passage 24 communicating with the material flow passageway 22 in the barrel portion of the gun for supply of paint via the hoses 14 and 18 (FIG. 1) from the tank or reservoir.

The forward end of the fluid tip 64 terminates in a nozzle 70 having a small diameter orifice 72 through which the coating material is emitted. The fluid tip further includes a coned seat 74 formed inside the nozzle 70 close to the discharge orifice 72.

An air cap 76 surrounds the forward end of the fluid tip 64. The air cap is mounted to the gun by means of an annular retaining ring 78 which is threaded over a threaded section of the barrel 12 at one end and at its other end there is an annular lip 80. The retaining ring 78 although rigid is sufficiently flexible at the lip 80 to permit the air cap to be snapped into position with the lip 80 engaging a wall 82 in an annular groove 84 in the outside surface of the air cap such that the air cap is securely retained and sealed against the escape of air to the atmosphere.

Flow of the atomizing air is through the openings 86 close to the nozzle 70, and flow of the fan-shaping air is through openings 88 in the opposed air horns 90.

The flow of paint through the axial flow passageways 22 and 24 is controlled by the control rod 62. The control rod 62 is mounted at its rear in a Delrin packing nut 92 and includes a flexible bellows seal 94 such that the control rod 62 is axially slidable in a forward and rearward direction upon operation of the trigger 26. The bellows seal is described in detail in my U.S. Pat. No.

4,079,894, assigned to the assignee of this invention, and those skilled in the art are referred thereto for the details of its construction and operation.

The control rod 62 terminates at its forward end in a cone-shaped tip 96. The coned tip cooperates with the internal seat 74 in the fluid nozzle 70 to form a needle and seat valve assembly actuatable by the trigger 26. That is, when the trigger 26 is pulled rearwardly, the rod 62 is retracted which retracts the cone-shaped tip 96 of the rod from the valve seat 74 immediately behind the material discharge orifice 72 allowing the paint in the passageway 24 to flow around the tip 96 and out the discharge orifice 72. When the trigger is released, a spring 98 moves the control rod 62 forwardly with the tip engaging the valve seat to thereby stop the flow of paint. As may be seen, the needle and valve seat, the discharge orifice and the control rod are all axially aligned and in line with a single material passageway through the barrel of the gun. Further, the valve seat is very close to the discharge orifice thereby providing for clean operation, there being very little paint retained in the gun downstream of the valve when the valve is closed. In addition, the valve is readily accessible for inspection, maintenance and repair. Thus, to service the valve it is merely necessary to remove the retaining ring and air cap and unscrew the fluid tip from the barrel 12. Replacement of the valve is worn or damaged is likewise easily accomplished merely by replacing the fluid tip portion 64 of the nozzle 13.

As described above, a resistor 54 is mounted in the barrel 12 of the gun between the spring 50 and the conductor 56. The resistor 54 is thus in series with the high energy electrical path passing through the barrel of the gun. Within the forward end of the control rod 62 is a second resistor 100. The forward end 102 of the resistor 100 is electrically connected to a thin, stainless steel wire electrode 104 extending through the discharge orifice 72 of the fluid nozzle 70. This electrode 104 ionizes the atomized paint emitted from the nozzle assembly 13. In one presently preferred embodiment, the electrode 104 is rounded having a diameter of 0.025 inches and a length of 0.69 inches. The electrode protrudes beyond the end of the fluid nozzle by 0.27 inches.

The resistor 100 and electrode 104 may be either molded into the rod 62 or potted in a preformed rod. In either case, the material forming the rod 62 protects the resistor and its electrical connections from chemical attack and abrasion from the coating materials passing through the passage 24.

The other end 106 of the resistor is in contact with the metallic pin 60 passing through the rod 62. The pin 60 in turn is in contact with the conical spring 58 contacting the electrical lead 56.

Accordingly, the conical spring 58 and pin 60 cooperate to form means electrically connecting the conductor 56 with the resistor 100 while permitting axial sliding movement of the actuating rod 62 to open and close the valve. The path of high voltage electrical energy from the resistor 54 is thus through the electrical lead 56, the conical spring 58, the pin 60, and the resistor 100 to the ionizing electrode 104. The resistor 100 thus lies in series in the high energy electrical path and lies forwardly or "downstream" of all the conductive components of the gun other than the ionizing electrode 104.

As set forth above, the nozzle 13 is substantially nonconductive, being made of Delrin which is a substantially nonconductive material, except for the electrode 104 itself. Thus, the amount of electrically conductive material in the forward portion of the gun forwardly or "downstream" of the blocking resistor 100 in the nozzle 13 is only the electrode 104 itself. Thus, the electric conductor 56, spring 58, and pin 60 are all rearward or "upstream" of the blocking resistor 100. Thus, the electrically conductive components at the forward end of the gun downstream of the resistor which would otherwise present high undamped electrical capacities have been greatly reduced so as to reduce the availability of capacitively stored energy undamped by a resistor.

The resistors 54 and 100 are commercially available. The values of the resistors will depend upon various factors. In an actual device designed for operation at up to 120 kv (open circuit), the resistor in the barrel 12 is 75 megohms and the resistor 100 in the nozzle 13 is 12 megohms. In general, the combined resistance must be great enough to damp out the accumulated effects of the high voltage cable and electrical components in the gun such as the conductors, springs, pins, etc. The value of the resistor 100 in the nozzle 13 must be great enough to damp out the effects of the electrical components between the resistor 54 in the barrel 12 and the resistor 100 in the nozzle. A desired value can be selected by ignition tests available and known to those skilled in the electrostatic spray coating art.

Although the invention has been described in terms of certain preferred embodiments, those skilled in the art will recognize that other forms may be adopted within the scope of the invention.

I claim:

1. An electrostatic coating apparatus comprising:

a nozzle made from a substantially nonconductive material having a coating material passageway in it terminating at one end in a material discharge orifice through which coating material is ejected, a charging electrode protruding from said nozzle orifice, a needle and seat valve in said nozzle passageway operative to selectively open and close said nozzle orifice, a high voltage electrical path passing through said valve adapted to connect said charging electrode to a source of high voltage electrical power, and a least a first series resistor in said needle in said electrical path.

2. The apparatus of claim 1 wherein said charging electrode has one end in said needle.

3. The apparatus of claim 1 which further comprises a barrel portion having said nozzle portion attached thereto, said barrel portion having a coating material conduit in substantial axial alignment with said coating material passageway in said nozzle and wherein a second resistor is located in said barrel portion.

4. The apparatus of claim 3 wherein the value of the resistance of said first resistor is smaller than the value of the resistance of said second resistor.

5. An electrostatic spray gun coating apparatus comprising:

a barrel portion having a coating material conduit and a high voltage electrical path therein, said path having a first and second end, said first end of said electrical path being adapted to be connected to a source of high voltage electrical power, a nozzle portion made of substantially nonconductive material connected to the forward end of said barrel portion and having a generally axial coating material passageway therethrough substantially axially aligned with said coating material conduit in said barrel, said passageway in said nozzle terminating at its forward end in a material discharge orifice through which coating material is ejected, valve means in said nozzle comprising a control rod axially slidably movable in said conduit in said barrel and in said passageway in said nozzle and a coned seat formed inside said nozzle close to said discharge orifice, said control rod being formed of an electrically nonconductive material and terminating at its forward end in a coned tip adapted to mate with said seat for controlling the flow of coating material through said discharge orifice, a charging electrode mounted at one end in said forward end of said control rod and protruding from said nozzle orifice, a high voltage electrical path passing through at least the forward end of said control rod, a first series resistor mounted in said forward end of said control rod in said electrical path passing therethrough, said first series resistor being connected at its forward end to said charging electrode, and means for electrically connecting the other end of said resistor to said second end of said electrical path in said barrel to thereby connect said charging electrode to said source of high voltage electrical power while permitting axial movement of said control rod.

6. The apparatus of claim 5 wherein said nozzle portion is removable from said barrel portion for inspection and maintenance of said valve means.

7. The apparatus of claim 5 further comprising a second series resistor in said electrical path in said barrel, the resistance of said first series resistor being smaller or equal to the resistance of said second resistor.

8. The apparatus of claim 7 wherein the resistance values of said first and second resistors are about 12 and 75 megohms, respectively.

9. The apparatus of claim 5 wherein said electrical connecting means comprises a metallic spring surrounding a portion of said control rod, first electrode means electrically connecting said spring to said second end of said electrical path in said barrel, and second electrode means passing through said rod and electrically connecting said other end of said resistor to said spring.

10. The apparatus of claim 9 wherein said first series resistor and the end of said electrode are potted in said control rod.

11. The apparatus of claim 9 wherein said first series resistor and the end of said electrode are molded into said control rod.

* * * * *